US005983774A

United States Patent [19]

Mihaita

[11] Patent Number: 5,983,774

[45] Date of Patent: Nov. 16, 1999

[54] MACHINE GUN

[76] Inventor: Ion Mihaita, 5416 Detroit Ave., Cleveland, Ohio 44102

[21] Appl. No.: 08/813,898

[22] Filed: Mar. 7, 1997

[51] Int. Cl.[6] ..... F41A 3/46

[52] U.S. Cl. ..... 89/187.02; 89/188; 89/191.01; 42/100; 42/103

[58] Field of Search ..... 89/187.01, 187.02, 89/183, 182, 188, 191.01; 42/103, 100

[56] References Cited

U.S. PATENT DOCUMENTS

| | | | |
|---|---|---|---|
| 943,949 | 12/1909 | Mauser | 89/182 |
| 2,089,671 | 8/1937 | Stecke | 89/183 |
| 2,921,502 | 1/1960 | Amsler | 89/149 |
| 4,213,261 | 7/1980 | Claypool | 42/16 |
| 4,677,898 | 7/1987 | Malhotra | 89/187.01 |
| 4,894,941 | 1/1990 | Karow, Jr. | 42/103 |
| 4,909,129 | 3/1990 | Reynolds | 89/191.01 |
| 5,179,235 | 1/1993 | Toole | 42/103 |
| 5,481,819 | 1/1996 | Teetzel | 42/103 |

FOREIGN PATENT DOCUMENTS

| | | | |
|---|---|---|---|
| 582097 | 9/1933 | Germany | 89/187.02 |
| 2822914 | 11/1979 | Germany | 89/187.02 |
| 344337 | 3/1960 | Switzerland | 89/187.02 |

*Primary Examiner*—Stephen M. Johnson

[57] ABSTRACT

A gas-operated firearm having a novel bolt construction that includes a locking roller that delays momentarily the action of the bolt upon the firing of the firearm, such delay permitting the bullet to exit the barrel before the bolt can move. The delay is achieved by tapping a portion of the gas generated by the cartridge only after the bullet passes a gas port in the gun barrel to release the locking roller.

3 Claims, 5 Drawing Sheets

FIG. 7
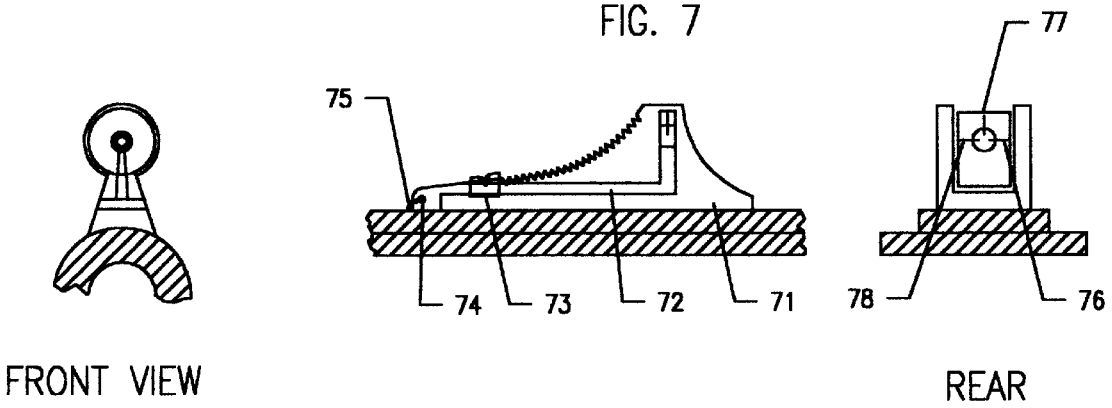
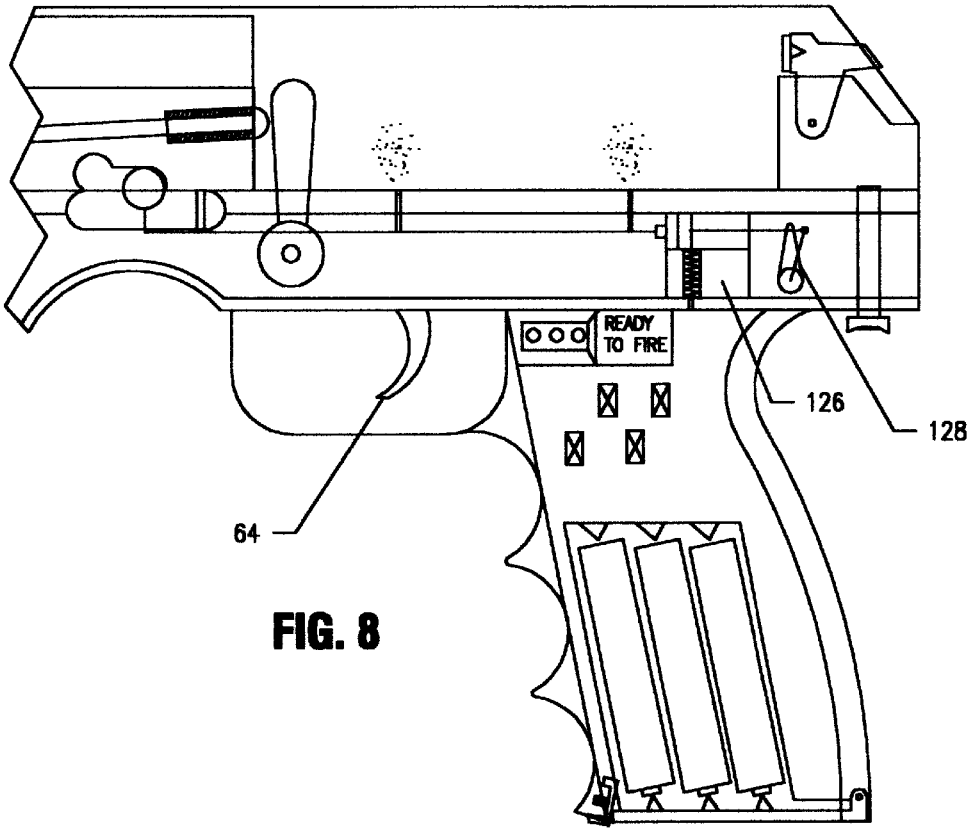
FIG. 8

MACHINE GUN

BACKGROUND OF THE INVENTION

The invention relates to models of firearms with locking roller bolts. More specifically, the present invention relates to a new bolt for firearms. The new bolt brake locks with a locking roller and is designed for two different models. One bolt is designed for a blow back operated weapon which fires from a closed bolt. The second bolt is designed for gas operated firearms which fire from a closed bolt. It should be recognized, however, that various aspects of the invention could also be utilized in other types of firearms such as pistols, rifles, shot guns, machine guns, and the like.

While there have been many bolts of various sorts, each had it's disadvantages. The new bolt characteristics are simple but are more efficient than other bolts because the new bolt is highly resistant to shock and is adaptable for highly stressed firearms such as high powered rifles, machine guns, and other applications.

The assembled bolt parts are: the bolt receiver, the bolt head, and locking roller which are easy to assemble and disassemble as needed. When the bolt is moved back and forth it cleans the space where it works.

Accordingly, It has been considered desirable to develop a new firearm bolt construction that would overcome the difficulties of it's predecessors while providing better and more advantageous overall results.

The first construction of the new bolt operates on a mechanical blow back while the second construction operates on gas. The normal firing cycle begins with the detonation of the cartridge primer. After the bullet passes a gas port in the barrel, a portion of the gas is tapped to drive a piston and it's bolt carrier to the rear. At this time the bolt cam releases the locking roller to the bolt head.

The firearms are provided with a handle grip which contains a battery pack and an electrical panel. The firearms contain a mini flashlight and laser beam. The firearms also provide a new rear sight invention, and contain a new automatic lubricating pump.

BRIEF DESCRIPTION OF THE DRAWINGS

The invention may take physical form in certain parts and arrangements of parts in preferred and alternate embodiments which will be described in detail in this specification and illustrated in the accompanying drawings which form a part hereof and within:

FIG. 7 is an enlarged cross sectional view of the rear sight of both firearms according to a preferred first embodiment. In addition this figure shows how the rear sight relates to the front sight for both firearms according to a preferred first embodiment.

FIG. 8 is an enlarged cross sectional view of a new push button lubricant pump for both firearms according to a preferred first embodiment.

DETAILED DESCRIPTION OF THE PREFERRED AND ALTERNATE EMBODIMENT

Figures 1, 2:
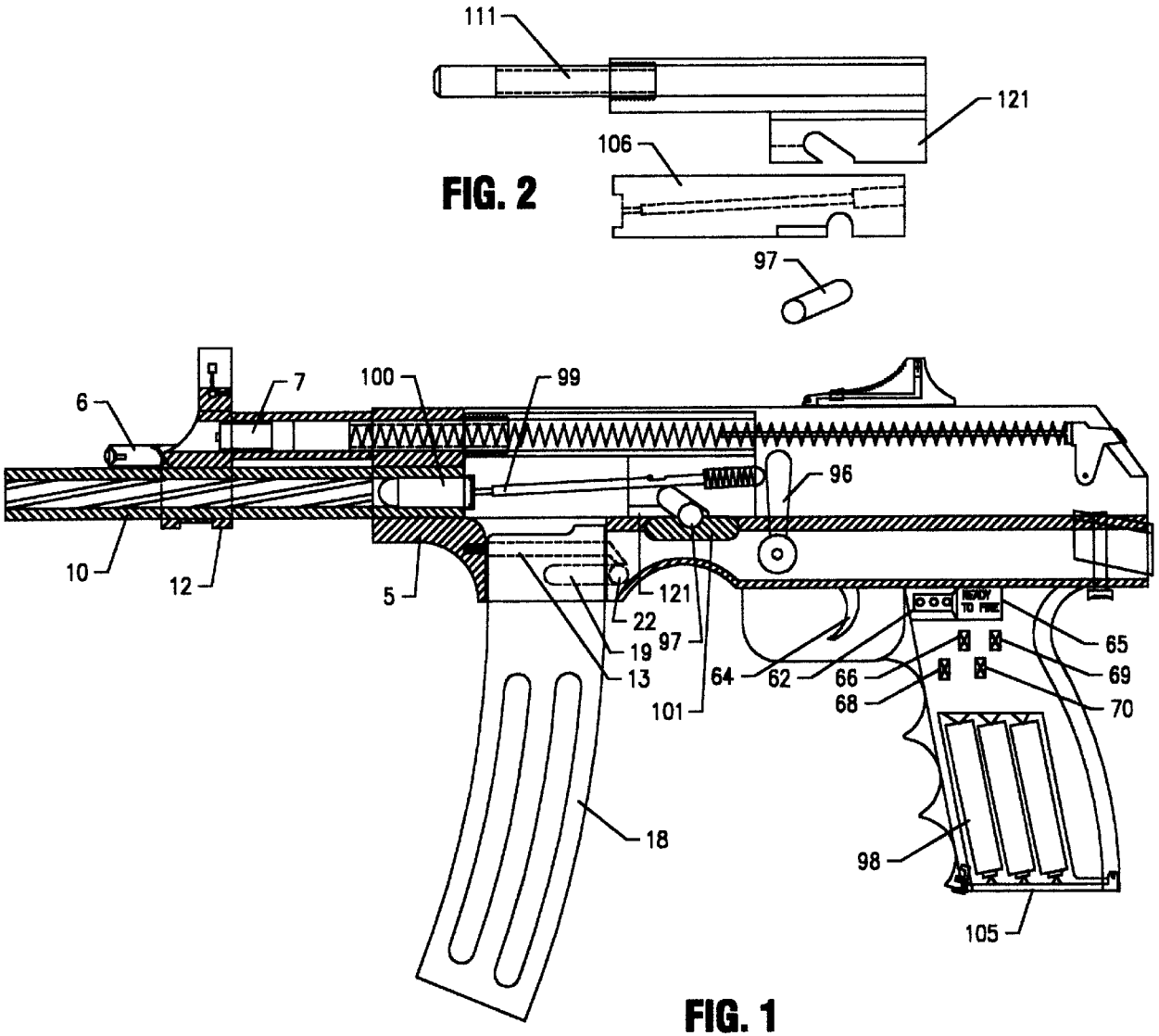
FIG. 1 is an enlarged cross sectional view of firearm model 1 according to a first preferred embodiment of the present invention. This firearm is operated by a mechanical blow back delay bolt.
FIG. 2 is an enlarged cross sectional view of the bolt carrier, head bolt, and locking roller of firearm model 1 according to a first preferred embodiment for the mechanically operated blow back bolt.

Referring now to the drawings wherein the showings are for purposes of illustrating preferred and alternate embodiments of the invention only and not for purposes of limiting same, FIG. 1 shows a preferred embodiment of the subject new firearm. While the firearm is primarily designed as and will herinafter be described as a submachine gun, it will be appreciated that the various control mechanisms of the overall inventive concept could also be adapted for use in many other firearm environments for, e.g., pistols, shot guns, rifles and the like.

More particularly, the machine gun Model 1 is loaded by cocking handle bolt 123 with the safety selector 63 in the off position. The weapon is fired by pulling the trigger 64 which releases the hammer 96. Hammer 96 then strikes the firing pin 99 which ignites the cartridge 100. The powder gas thus generated drives the bullet out of the barrel 10. At the same time the gas also exerts pressure on the cartridge case 100.

With additional reference to FIG. 2 the bolt carrier 121 is assembled with bolt head 106 and linked together by inserting bolt locking roller 97. The bolt receiver operates on a delayed blow back which fires from a closed bolt. After cartridge 100 is ignited the gaseous pressure causes forces to at on the bolt head 106, a portion of these forces are transmitted to the locking roller 97. The locking roller 97 is located in the frame 101 which is cammed into the bolt carrier 121. When bolt Head 106 presses the locking roller 97, locking roller 97 goes into the bolt slot located in bolt head 106. Locking roller 97 presses the bolt carrier 121 back. Bolt cover 121 is fully cammed at an angle via locking roller 97. The angular ratio of locking roller 97 and the bolt carrier 121 results in a delayed recoil movement of the bolt head 106. This delayed recoil guarantees that the bolt receiver keeps the barrel 10 locked until the bullet has left the barrel 10.

Figures 1A, 3:
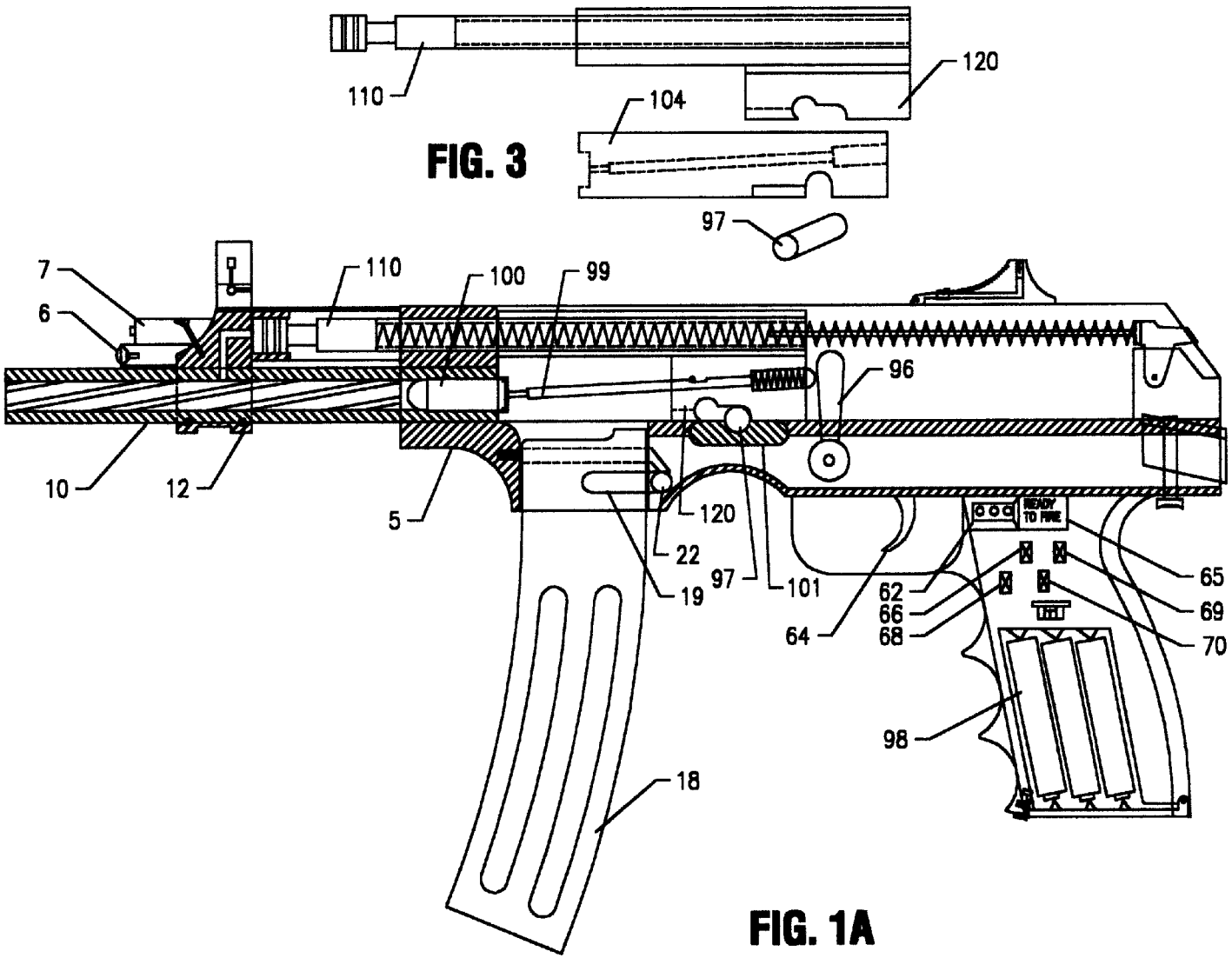
FIG. 1A is an enlarged cross sectional view of firearm model 2 according to a first preferred embodiment of the present invention. This firearm is operated by a gas delay bolt.
FIG. 3 is an enlarged cross sectional view of the bolt carrier, head bolt, and locking roller of firearm model 2 according to a first preferred embodiment for the gas operated bolt.

With reference to FIG. 1A and FIG. 3, Model 2 is a submachine gun with a gas operated bolt receiver. The normal firing cycle begins with the detonation of the cartridge 100 primer. After the bullet passes the gas port in barrel 10 a portion of the gas thus produced is tapped to drive the piston rod 110 and its bolt carrier 120 to the rear. At this time the bolt carrier's 120 cam releases locking roller 97 to the bolt head 104.

Figure 4:
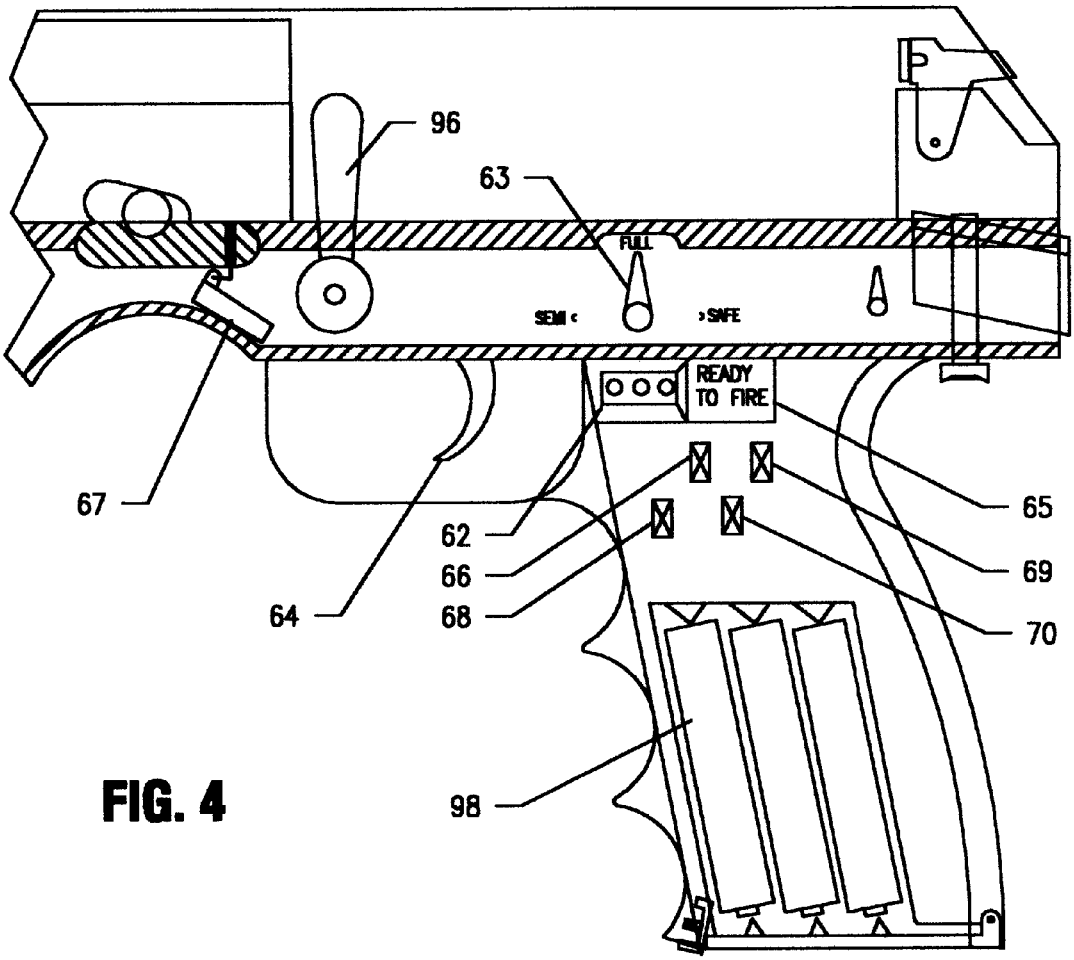
FIG. 4 is an enlarged cross sectional view of the handle grip, battery pack, and electrical panel of both firearms according to a first preferred embodiment.

With reference to FIG. 4, Model 1 and Model 2 have a handle which contains a battery pack 98 and an electrical panel. Electric panel cartridge counter 62 which counts the number of cartridges fired is connected to sensor 67. Sensor 67 is in contact with cartridge 100 when it leaves the magazine 18. Electrical switch 68 is connected to cartridge counter 62. Electrical switch 68 resets cartridge counter 62 to zero. Safety light 65 is connected to safety selector fire switch 63. When safety selector fire switch 63 is off, fire safety selector light 65 is on. Electrical switch 70 is connected to safety light 65, which turns safety light 65 on and off. Electrical switch 66 is connected to the laser 7. Electrical switch 69 is connected to the mini Flashlight.

Figure 5:
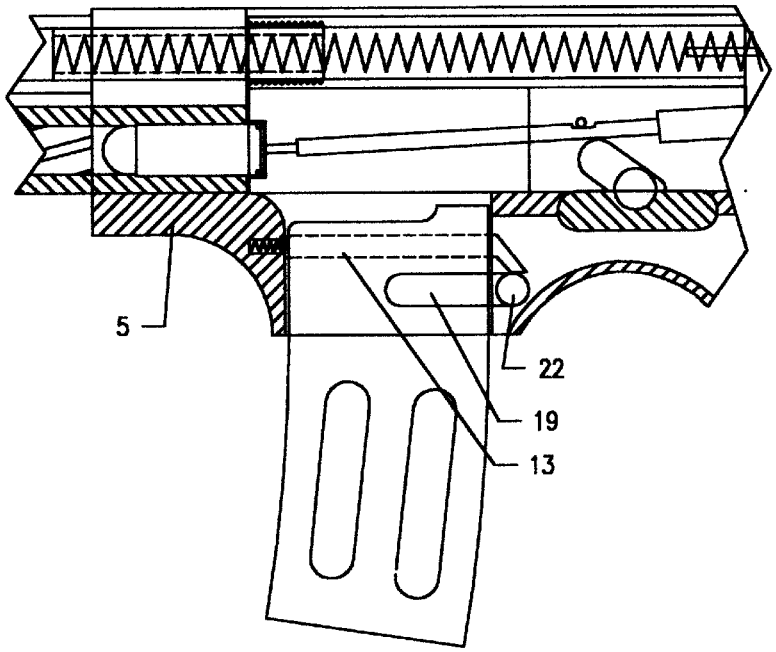
FIG. 5 is an enlarged cross sectional view of the magazine holder with new locking mechanism and special locking button for both firearms according to a first preferred embodiment.

With reference to FIG. 5, Model 1 and Model 2 have a magazine holder with a new special releasing button 22. Magazine releasing button 22 engages and disengages magazine holder 19 and magazine holder 13. Magazine holder 19 is connected to magazine holder 13 by cross piece 17 which is cammed to magazine releasing button 22.

Figure 6:
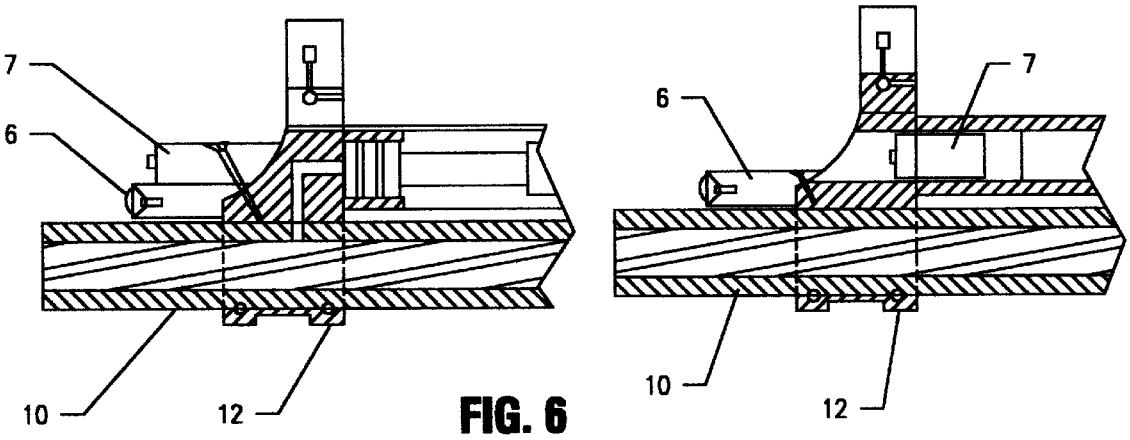
FIG. 6 is an enlarged cross sectional view of the mini flashlight and laser for both firearms according to a first preferred embodiment.

With reference to FIG. 6, Model 1 and Model 2 have a mini flashlight 6 and laser 7 which are attached to support sight 12. Mini flashlight 6 is wired to electrical panel switch 69. Laser 7 is wired to electrical panel switch 66.

With reference to FIG. 7, Model 1 and Model 2 have a rear sight 72 which is connected to frame 71 by pin 74. Rear sight 72 is elevated by sight lifter 73 for target and range adjustment. Rear sight 72 is held down by spring 75. Rear sight 72 has a centering hole which is adjusted by right adjusting pin 76, up and down adjusting pin 77, and left adjusting pin 78.

With reference to FIG. 8, Model 1 and Model 2 have a new automatic lubricant pump 126 which is connected to push button 128. Lubricant pump 126 sprays lubricant on gun frame 5 and the receiver bolt assembly.

Having thus described the preferred and alternative embodiments, the invention is claimed as follows:

1. A gas-operated firearm comprising:

a bolt arrangement containing a bolt head with associated bolt carrier, a frame for the firearm containing an upwardly-opening groove, said bolt head having a bolt slot and the bolt carrier having a downwardly-opening cam groove, a locking roller, said locking roller contained in a lower portion of the cam groove and in the upwardly-opening groove when the bolt arrangement is locked and said locking roller contained in an upper portion of the cam groove and in said bolt slot of the bolt head when the bolt arrangement is unlocked, and a firing pin that extends through both the bolt head and the bolt carrier, and a hammer pivotably attached behind the locking roller to move the firing pin forwardly.

2. A gas-operated firearm as claimed in claim 1, comprising:

a laser sighting device and associated activation means, and further comprising front and rear sights located on an upper surface of the frame.

3. A gas-operated firearm as claimed in claim 2 comprising:

said rear sight wherein said rear sight is adjustable in both elevation and azimuth.

* * * * *